United States Patent [19]

Lin

[11] Patent Number: 4,966,399

[45] Date of Patent: Oct. 30, 1990

[54] LOCK SET WITH SPINDLE LOCK

[76] Inventor: Jui C. Lin, 297, Bor Ay Rd., Kaohsiung, Taiwan

[21] Appl. No.: 340,753

[22] Filed: Apr. 19, 1989

[51] Int. Cl.[5] ..... E05C 21/00

[52] U.S. Cl. ..... 292/359

[58] Field of Search ..... 292/336.3, 169.22, 169.23, 292/359; 70/216

[56] References Cited

U.S. PATENT DOCUMENTS 3,035,432 5/1962 De Vines ..... 292/359 X 3,556,576 1/1971 Nelson et al. ..... 292/359

*Primary Examiner*—Richard E. Moore

*Attorney, Agent, or Firm*—Fleit, Jacobson, Cohn, Price, Holman & Stern

[57] ABSTRACT

A cylindrical lock comprising two limit plates, whose movement can control the outside knob and the inside knob both unturnable or the outside knob unturnable but the inside knob turnable.

3 Claims, 9 Drawing Sheets

LOCK SET WITH SPINDLE LOCK

BACKGROUND OF THE INVENTION

A cylindrical lock is commonly divided into a trumpet lock and a tubular lock. The main difference between both locks is that the latter is locked or unlocked by turning a turning button and the dead bolt is directly moved by the tubular shaft of the inside or the outside knob, and the former is locked by pressing a button and the dead bolt is moved by the latch retractor. Therefore, both the locks have difference in their structure and the shape of the knobs. Subsequently, makers have to be equipped with two different sets of molds for production.

In addition, conventional tubular locks have a drawback by which they can easily be unlocked stealthily owing to their unsteady locking movement For example, that of an U.S. patent titled "Holding device for a lockset", Ser. No. 3,556,576 dated Jan. 19, 1971, has a comparatively strong structure, but it still has the disadvantage just described. Besides, the inside knob cannot be turned to unlock the lock after the lock is locked. So in practical use, the tubular lock has evidently worse function than the trumpet lock, and consequently is less widely used.

SUMMARY OF THE INVENTION

The object of this invention is to provide a cylindrical lock equipped with a simple structure for easier manufacture, and for locking with steadfasteness and with knobs applicable to a trumpet lock.

Besides, another object of this invention is to enable this lock to be used as a tubular lock and to keep the inside knob still turnable to open the door after locked, but the locked condition is still maintained for the outside knob, which cannot be revolved to open the door.

This cylindrical lock in accordance with the present invention comprises an inside knob and an outside knob, and a long flat moving rod set between a turning button of the inside knob and a key hole block of the outside The moving rod can be turned for about 90° from the unlocked horizontal position to the locked vertical position, moving two limit plates up. When said limit plates are moved up, they stick in an aperture of an inner cap, blocking both the knobs inside and outside from turning. But if said limit plates are moved down back to the original position, both knobs become turnable. This is the first example.

The second example has one of the two limit plates additionally provided with a protrusion 283, which is not provided in the first example, to stick in an additionally provided notch 251(not existing in the first example) of the square shaft 25. Beside, the replacing plate 26 has a central round shaft hole 264 instead of a square shaft hole 263 in the first example. Therefore the inside knob and the outside knob still are in the mutual moving condition as long as the protrusion 283 is sticking in the notch 251. But if the protursion 283 is made to separate from the notch 251, the inside knob is no longer in the reciprocal movement with the outside knob, and if this lock is in the locked condition, the locking function is effective only to the outside knob, but not to the inside knob, which can still be revolved to unlock this lock to open the door.

BRIEF DESCRIPTION OF THE DRAWINGS

This invention will now be described in detail with reference to accompanying drawings wherein.

DETAILED DESCRIPTION OF THE INVENTION

Figure 1:
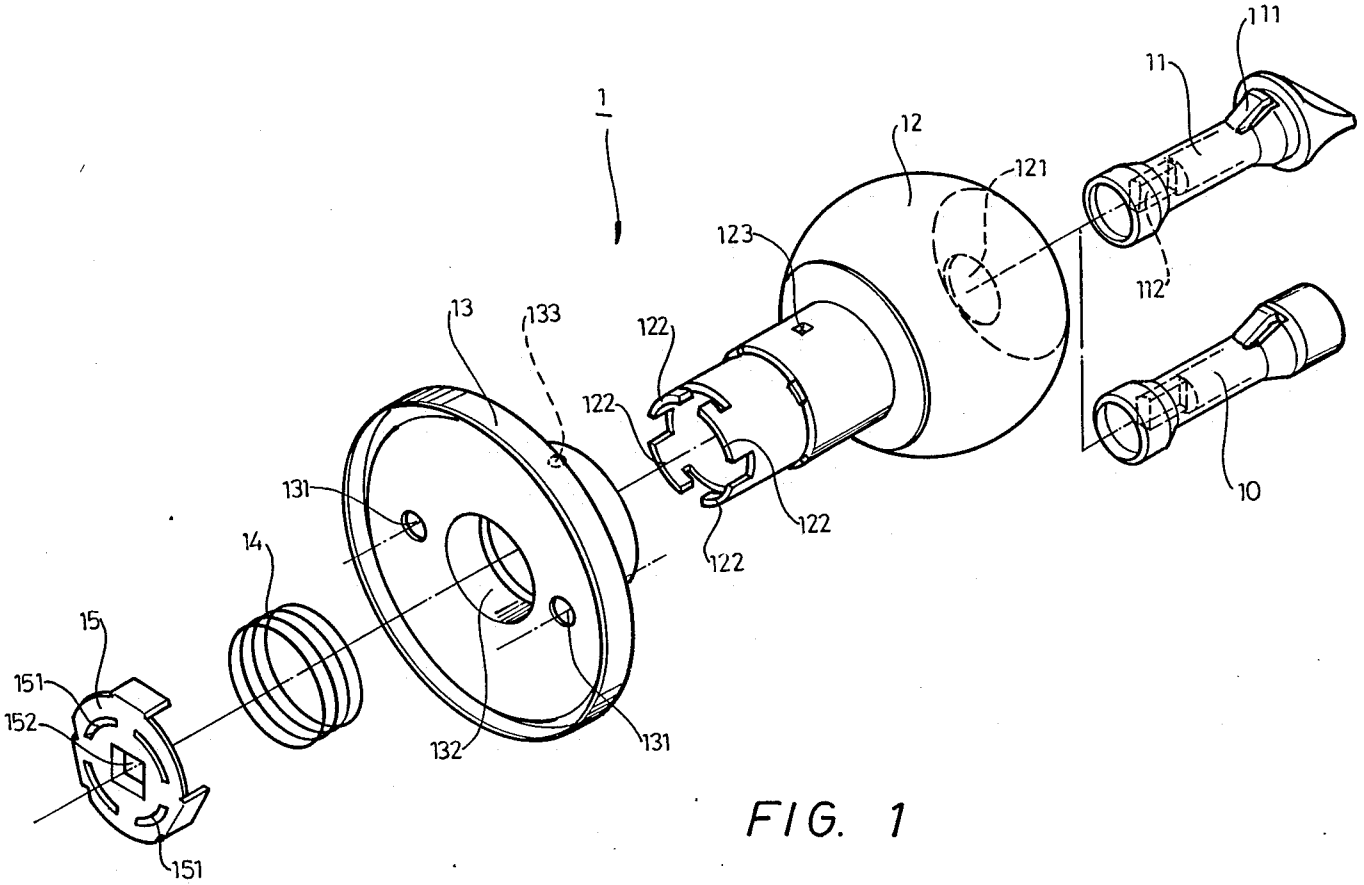
FIG. 1 is an exploded perspective view of the inside knob of the cylindrical lock in accordance with the present invention.

First, referring to FIG. 1, the cylindrical lock in accordance with the present invention includes an inside knob 1, which comprises a turning button 11, a grip 12, an inside knob cap 13, a coil spring 14 and an inside moving plate 15.

Figure 3:
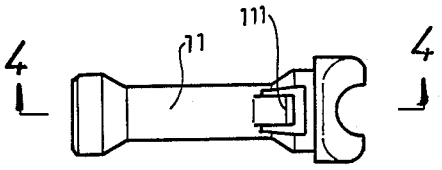
FIG. 3 is a plan view of the turning button in the cylindrical lock in accordance with the present invention.
Figure 4:
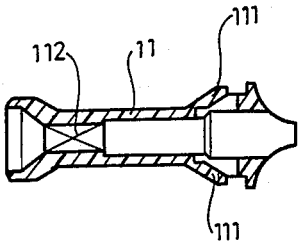
FIG. 4 is a cross-sectional view taken along line 4—4 of FIG. 3.
Figure 5:
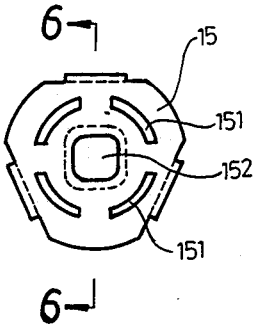
FIG. 5 is a front view of the inside moving plate in the cylindrical lock in accordance with the present invention.
Figure 6:
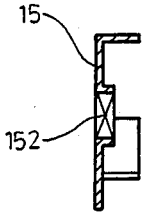
FIG. 6 is a cross-sectional view taken along line 6—6 of FIG. 5.
Figure 7:
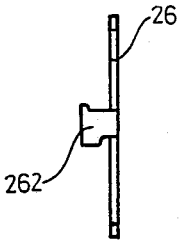
FIG. 7 is a side view of the replacing plate in the cylindrical lock in accordance with the present invention.
Figure 8:
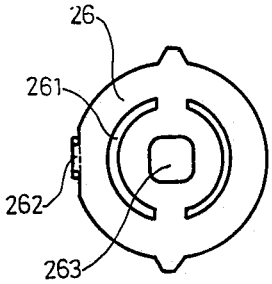
FIG. 8 is a front view of the replacing plate in the cylindrical lock in accordance with the present invention.

The turning button 11 shown in FIG. 1, 3 and 4 is set to be applied to a tubular lock, formed of plastics and provided with an elastic protrusion 111 to stick in the wall edge of a hole 121 of the grip 12 when said button 11 is inserted in the hole 121 so that said button 11 cannot easily fall off without using a tool. The turning button 11 is also provided with an inner oblong hole 112 for a moving rod 29 to assemble with.

The grip 12 can be applied to both a trumpet lock and a tubular one, provided with the hole 121 for the turning button 11 to insert and for the protrusion 111 to stick at the wall edge of the hole 121, said wall edge being used as a guide rail for said button 11. Said hole 121 can also be used for a push button to be directly fitted therein in case the lock is applied to a trumpet lock 10. The grip 12 is also provided with four moving petals 122 at the tubular end to fit into slots 151 of the inside moving plate 15 for mutual hooking combination.

The inside knob cap 13 is to be fixed on a door with screws, provided with two holes 131 for screws to pass through and an opening 132 in the center for the tubular portion of the grip 12 to fit therein and a protrusion 133 at the inner wall to stick in a protrusion hole 123 on the tubular portion of the grip 12 to keep the grip 12 from coming off.

The coil spring 14 is to be placed around the tubular portion of the grip 12, with one end resting on the inside knob cap 13 and the other resting on the inside moving plate 15.

Figure 2:
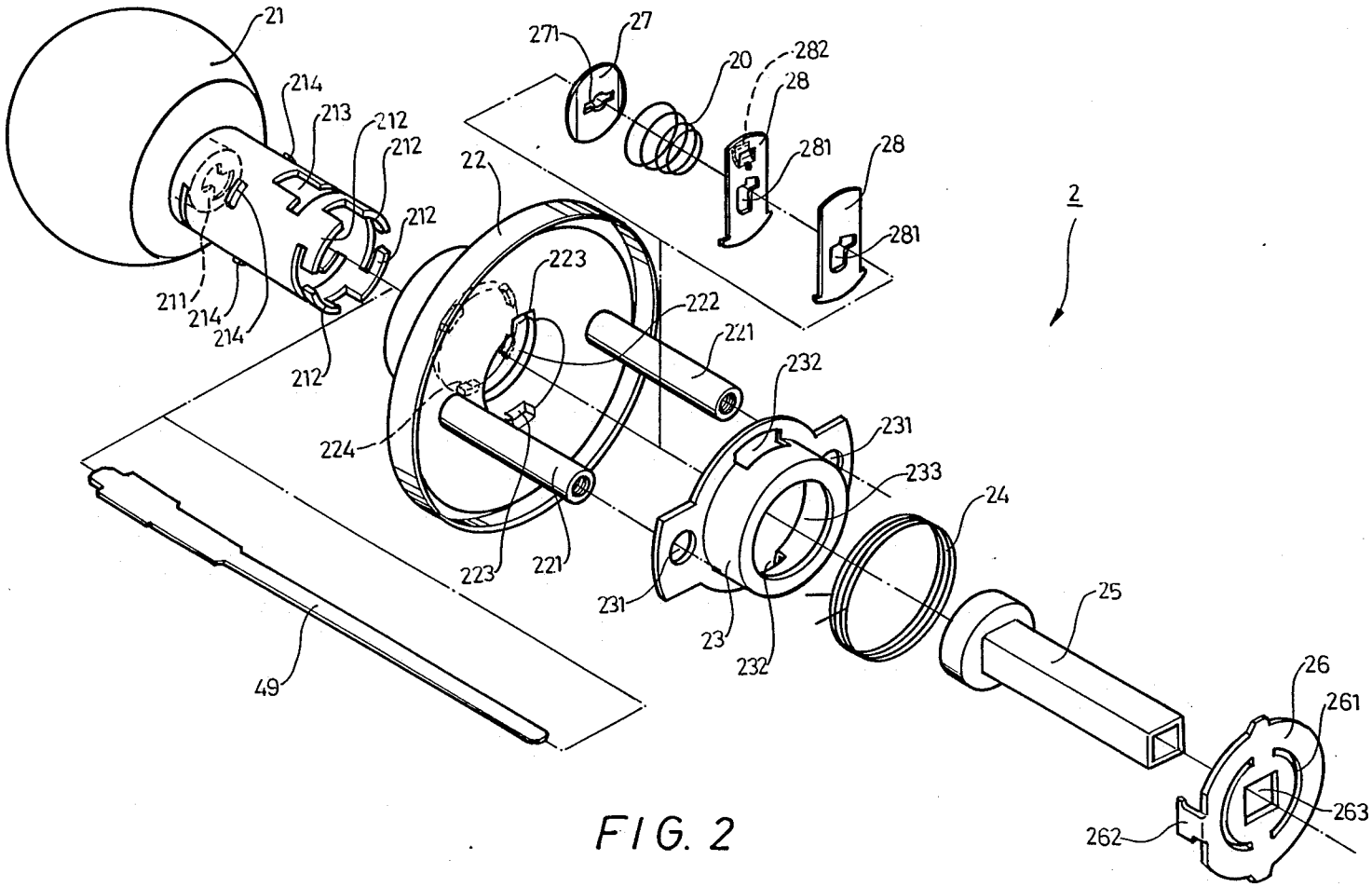
FIG. 2 is an exploded perspective view of the outside knob of the cylindrical lock in accordance with the present invention.

The inside moving plate 15 is provided with four curved slots 151 properly spaced apart for the four moving petals 122 of the grip 12 to stick in and a square shaft hole 152 at the center for a square shaft 25 of an outside knob. 2 to fit in for mutual movement Next, referring to FIG. 2, this cylindrical lock also includes an outside knob 2, which is provided with a grip 21, an outside knob cap 22, an inner cap 23, a coil spring 24, a square shaft 25, a replacing plate 26, a fixing plate 27, two limit plates 28 and a moving rod 29.

The grip 21 is the same as that of a conventional cylindrical lock, provided with a key hole block 211 to connect with the moving rod 29, four moving petals 212 at the end of the tubular portion to stick in two curved slots 261 properly spaced apart in the replacing plate 26, an aperture 213 for the limit plates 28 to extend upward through and an protrusion 214 to stick in a protrusion hole 224 of the outside knob cap 22 for mutual combination.

The outside knob cap 22 is to be fixed on a door by means of two female-threaded posts 221 thereof extending horizontally inward and to be combined with the grip 21, provided with a shaft hole 222 for the tubular portion of the grip 21 to fit in, two placing notches 223 symmetrically set at the upper and the lower edge of said shaft hole 22 for a sticking protrusion 282 of one of the limit plates 28 to stick in the upper notch 223.

Figure 9:
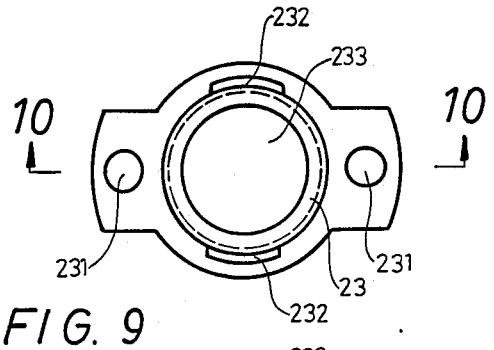
FIG. 9 is a front view of the inner cap in the cylindrical lock in accordance with the present invention.
Figure 10:
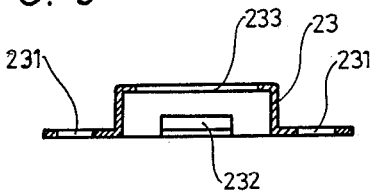
FIG. 10 is a cross-sectional view taken along line 10—10 of FIG. 9.

The inner cap 23 shown in FIGS. 2, 9 and 10 is provided with two symmetrical holes 231 for the female-threaded posts 221 to pass through. Between the inner cap 23 and the outside cap 22 are placed the fixing plate 27, the limit plates 28 and a coil spring 20. The inner cap 23 is also provided with an aperture 232 for the limit plates 28 to extend one of such that said limit plates 28 are unturnable, and a round opening 233 at the center for the square shaft 25 to pass through. A coil spring 24 is placed around the inner cap 23, having both ends sticking at both sides of a foot 262 of the replacing plate 26 and only one end sticking at one side of one of said posts 221 at the same time.

The square shaft 25 has a round end surface to contact one of the limit plates 28, and a square portion to pass through a square shaft hole 263 of the replacing plate 26 and to fit in the square hole 152 of the inside moving plate 15 as well.

The replacing plate 26 is provided with two curved slots 261 for the moving petals 212 of the grip 21 to stick in, a square hole 263 for the square shaft 25 to fit therethrough and a foot 262 extending vertically for both ends of the coil spring 24 to hook at both sides of said foot and one end of said spring 24 simultaneously sticking at one side of one of the posts 221 such that the spring 24 can urge the grip 21 to turn back to its original position by aid of the replacing plate 26 when the turning force against the grip 21 disappears.

The fixing plate 27 is placed in the shaft hole 222 of the outside cap 22 for one end of the coil spring 20 to rest upon, and provided with an elongate hole 271 for the moving rod 29 to pass through.

Figure 11:
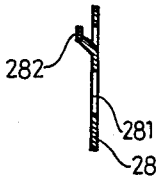
FIG. 11 is a cross-sectional view taken along line 11—11 of FIG. 12.
Figure 12:
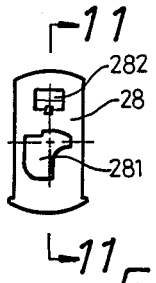
FIG. 12 is a front view of one of the limit plates in the cylindrical lock in accordance with the present invention.
Figure 13:
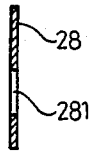
FIG. 13 is a cross-sectional view taken along line 13—13 of FIG. 14.
Figure 14:
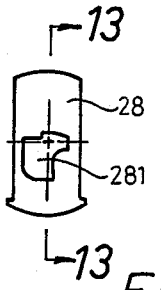
FIG. 14 is a front view of the other limit plate in the first example in accordance with the present invention.

The two limit plates 28 shown in FIGS. 2, 11 and 12 have a reversed-L-shaped aperture 281 for the moving rod 29 to pass through and to move up the limit plates 28 when said rod 29 is turned from the unlocking horizontal position to the locked vertical position. The limit plates 28 are retracted within the inside cap 23 under the horizontal position of said rod 29 and can be raised up to stick in the aperture 232 of the inner cap 23 and the sticking protrusion 282 of one of the limit plates 28 can stick in the upper placing notch 223 of the outside cap 22 when said rod 29 is turned for 90° to become vertical.

The moving rod 29 is long and flat, having one end fixed in the key hole block 211 of the grip 21 and the other end fixed in the inside oblong hole 112 of the turning button 11, and penetrating through the fixing plate 27, the limit plates 28 and the square shaft 25.

Figure 17:
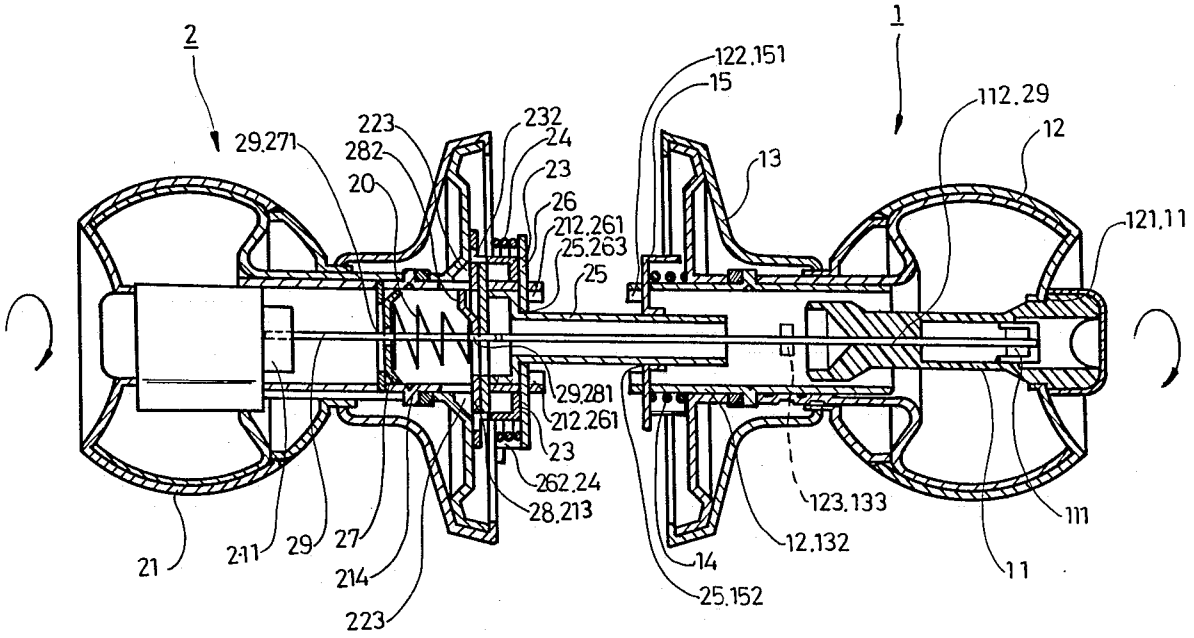
FIG. 17 is a cross-sectional view of the first example of the cylindrical lock in the unlocked condition.

Now, referring to FIG. 17, a cross-sectional view of this cylindrical lock of the first example, the turning button 11 of the inside knob 1 is in the original unlocked position, the moving rod 29 lying horizontal, the limit plates 28 drawn down and retracting within the inner cap 23, the upper end of said plates 28 extending out of the aperture 213 of the grip 21, and the sticking protrusion 282 of one limit plate 28 not sticking in the placing notch 223 of the outside knob cap 22. Under this position, if the grip 21 is turned properly, the moving petals 212 revolves in order the replacing plate 26, which revolves in turn the square shaft 25. Then said shaft 25 can pull in the dead bolt to open the door. Under the same condition, if the inside grip 12 is turned properly, said grip 12 also revolves the inside moving plate 15, which revolves om turn said shaft 25 engaging with said plate 15. Then the dead bolt can be pulled in by the shaft 25 to open the door, too.

Figure 18:
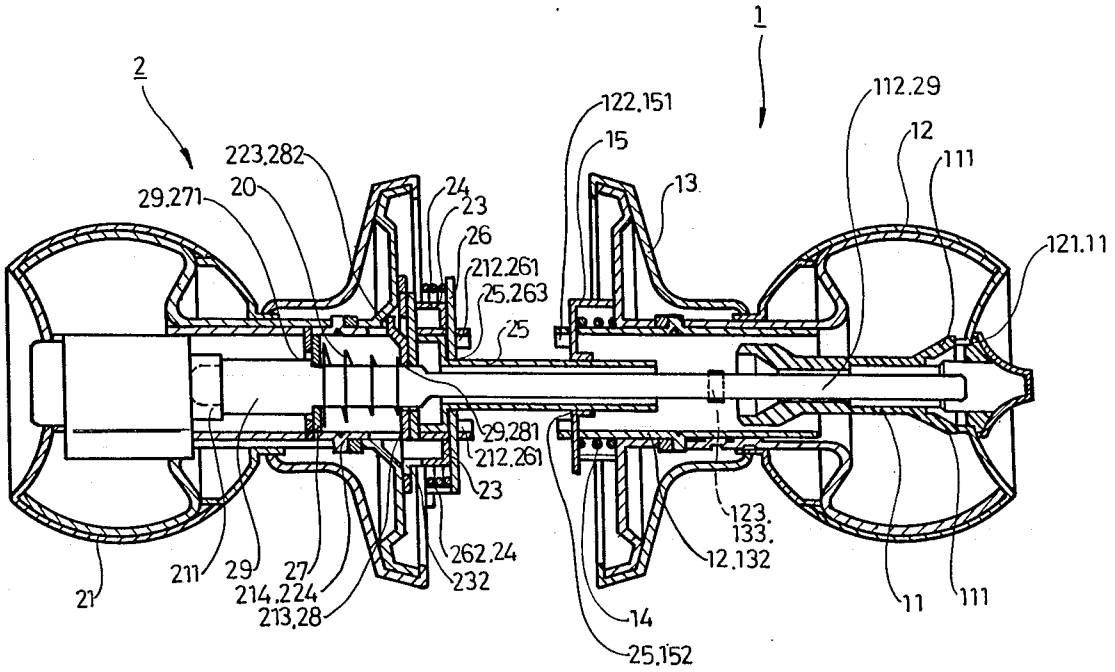
FIG. 18 is a cross-sectional view of the first example of the cylindrical lock in the locked condition.

Now, referring to FIG. 18, if a right key is inserted in the key hole to turn the key hole block 211, or the turning button 11 is turned, to make the moving rod 29 revolve for 90° to become vertical, said rod 29 can move up the limit plates 28 such that the limit plates 28 stick in the aperture 232 of the inner cap 23 and the sticking protrusion 282 sticks in the upper placing notch 223. Then the outside grip 21 can never be revolved to open the door, because said grip 21 is blocked from turning by the limit plates 28. Neither can the inside grip 12 be revolved to open the door, as the inside moving plate 15 is engaged with the square shaft 25, which in turn engages with the replacing plate 26, which is blocked from turning by the moving petals 212 of the grip 21 sticking in the slots 261.

Figure 19:
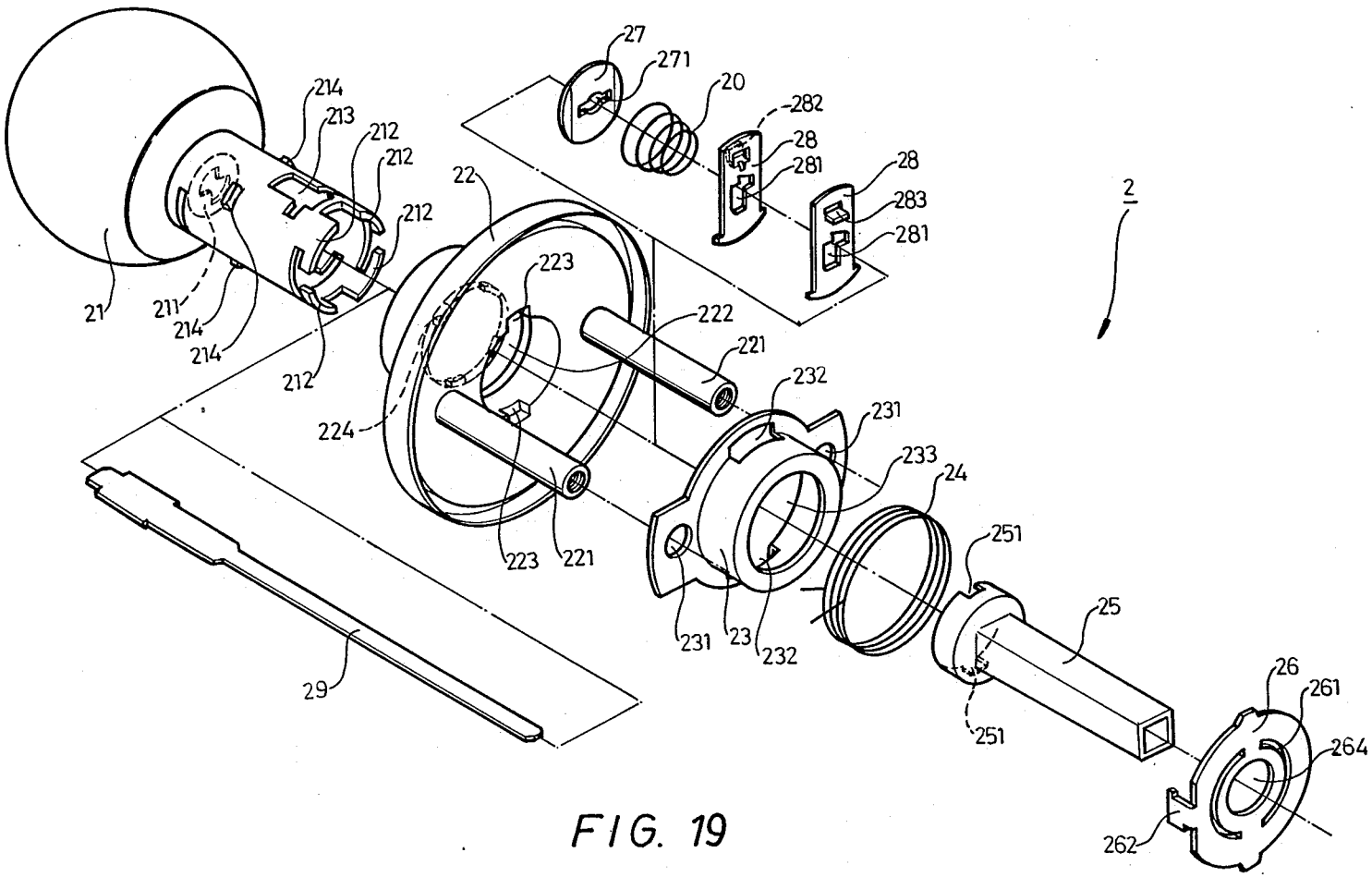
FIG. 19 is an exploded perspective view of the outside knob in the second example of the cylindrical lock.

Now, referring to FIG. 19, the cylindrical lock of the second example has an improved structure in regard to the unturnable problem of the inside grip 12 when the lock is in the locked condition. The improvement in the second example is added to the structure of the limit plates 28, the square shaft 25 and the replacing plates 26 in the first example.

Figure 15:
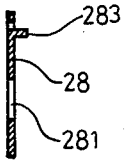
FIG. 15 is a cross-sectional view taken along line 15—15 of FIG. 16.
Figure 16:
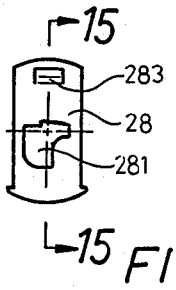
FIG. 16 is a front view of the other limit plates in the second example in accordance with the present invention.

As FIGS. 19, 15 and 16 show, one of the limit plates 28 in the first example is of flat surface, but is changed to be provided with a protrusion 283 in the second example so as to stick in or separate from a newly added notch 251 of the square shaft 25.

The square shaft 25 is newly added with two notches 251 at the round end for the protrusion 283 of the limit plate 28 to stick in case said plate 28 is raised up and to separate therefrom in case of said plate 28 is moved down. The replacing plate 26 in the first example has a square hole 263, but in the second example it has a round hole 264 instead of a square hole for the square shaft 25 to pass through without mutual movement.

Figure 20:
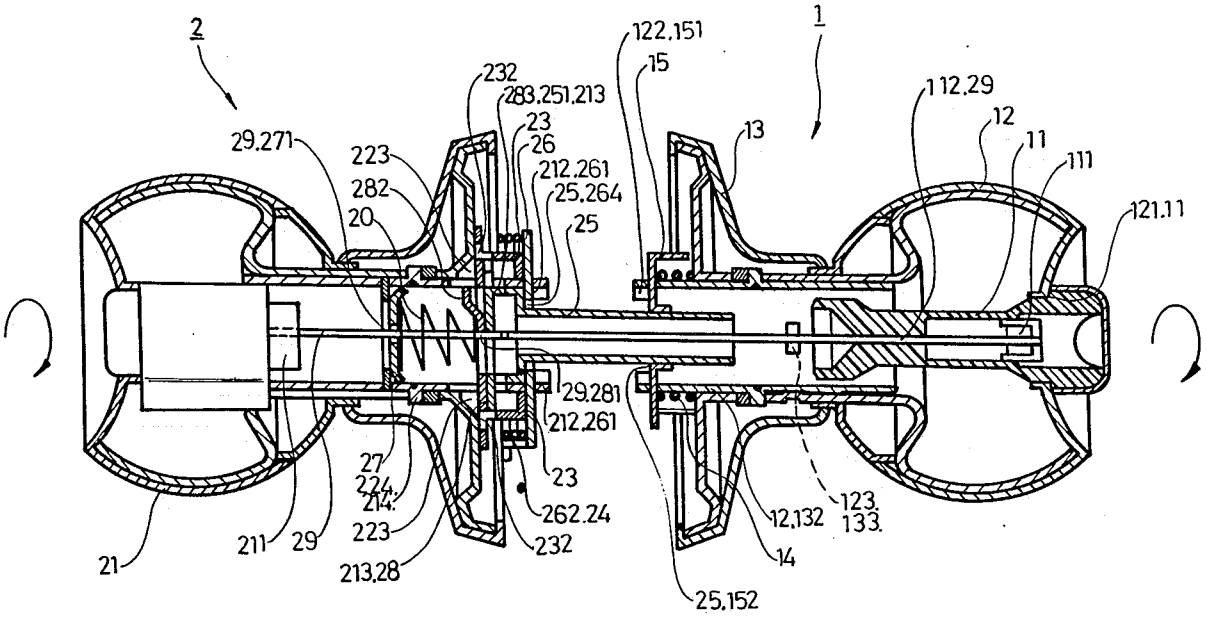
FIG. 20 is a cross-sectional view of the second example of the cylindrical lock in the unlocked condition.

Referring to FIG. 20, a cross-sectional view of the second example in the unlocked condition, the moving rod 29 lies flat or horizontal, the limit plate 28 drawn down and retracted within the inner cap 23, the protrusion 283 sticking in the notch 251 of the square shaft 25. Under this condition, if the outside grip 21 is revolved properly, the square shaft 25 revolved by the limit plates 28 can directly pull in the dead bolt. And if the inside grip 12 is revolved properly, the square shaft 25 revolved by the moving plate 15 can directly pull in the dead bolt.

Figure 21:
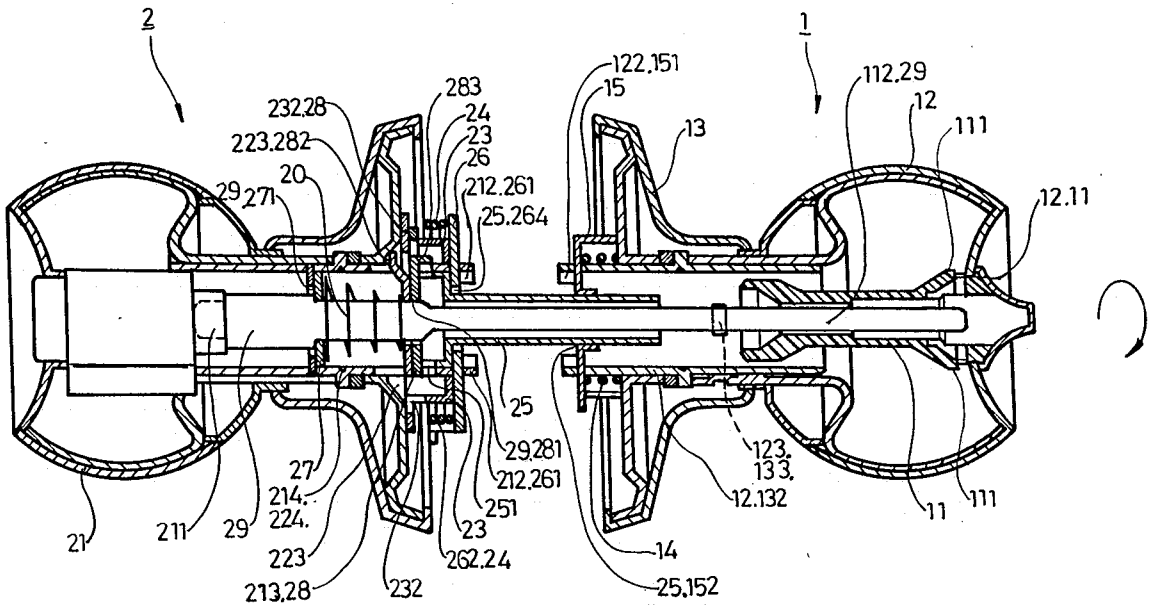
FIG. 21 is a cross-sectional view of the second example of the cylindrical lock in the locked condition.

Referring to FIG. 21, if the turning button 11 or a right key revolves the moving rod 29 for 90° to become vertical, the limit plates 28 can be raised up to stick in the aperture 232 of the inner cap 23, the protrusion 282 sticking in the placing notch 223 of the outside knob cap 22, the protrusion 283 separating from the notch 251 of the square shaft 25, then the lock becomes locked. Under this condition, the outside grip 21 is impossible to revolve, hampered by the limit plates 28, but the inside grip 12 is possible to revolve to open the door, because the square shaft 25 can revolve to pull in the dead bolt, the notch 251 being separated from the protrusion 283.

What is claimed is:

1. A spindle lock comprising;

an inside knob provided with a grip having a central round hole for fixing a turning button therein, said turning button having a protrusion sticking at the round hole and an inside oblong hole for one end of a long flat moving rod to stick in, said grip having moving petals at a tubular end to engage with an inside moving plate combined with a square shaft for mutual movement;

an outside knob provided with a grip having a tubular end fitting with a replacing plate, which has a square hole, a square shaft in the end fitting and passing through the square hole for mutual movement of the shaft and fitting, said outside knob grip having its tubular portion fitting in a shaft hole of an outside knob cap, said shaft hole provided with two symmetrical placing notches, two limit plates carried by the moving rod and located in the placing notches, said limit plates being also covered by an inner cap having a peripheral aperture, said long flat moving rod having one end fixed in a key hole block in the outside knob and the other end connected with the turning button of the inside knob; and said long flat moving rod capable of being revolved by the turning button to move the limit plates up and down, said limit plates being retracted within the inner cap and located in the shaft hole of the outside knob cap when they are moved down, said limit plates sticking in the peripheral aperture of the inner cap blocking the outside grip from revolving when they are moved up.

2. The lock as claimed in claim 1, wherein one of said limit plates is provided with a protrusion to stick in one of said placing notches of the outside grip when said limit plates are moved up.

3. The lock as claimed in claim 1, wherein the square shaft and the replacing plate have mutual movement, said square shaft being provided with a round end having a notch for a protrusion of one of the limit plates to stick in, enabling said square shaft and the outside grip to move each other when said limit plates are moved down, and said protrusion separating from said notch making said square shaft and said outside grip unmovable relative to each other when the limit plates are moved up.

* * * * *